US007367651B2

(12) United States Patent
Kang

(10) Patent No.: US 7,367,651 B2
(45) Date of Patent: May 6, 2008

(54) INKJET PRINTING HEAD AND INKJET PRINTER USING THE SAME

(75) Inventor: Sung-wook Kang, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 221 days.

(21) Appl. No.: 11/148,185

(22) Filed: Jun. 9, 2005

(65) Prior Publication Data

US 2006/0066670 A1 Mar. 30, 2006

(30) Foreign Application Priority Data

Sep. 25, 2004 (KR) ..... 10-2004-0077599

(51) Int. Cl.
*B41J 2/205* (2006.01)

(52) U.S. Cl. ..... 347/43; 347/42; 347/104

(58) Field of Classification Search ..... 347/42, 347/13, 16, 105, 12, 43, 104, 40
See application file for complete search history.

(56) References Cited

U.S. PATENT DOCUMENTS 6,578,950 B2 6/2003 Matsumoto et al.
6,874,865 B2 * 4/2005 Eguchi et al. ..... 347/42
2002/0024557 A1 * 2/2002 Matsumoto et al. ..... 347/42
2003/0058307 A1 3/2003 Eguchi et al.

FOREIGN PATENT DOCUMENTS

| | | |
|---|---|---|
| JP | 05-024192 | 2/1993 |
| JP | 08-090814 | 4/1996 |
| JP | 2000-289233 | 10/2000 |
| JP | 2000-343716 | 12/2000 |
| JP | 2002-264322 | 9/2002 |
| KR | 2002-0014713 | 2/2002 |

* cited by examiner

*Primary Examiner*—Lamson Nguyen
(74) *Attorney, Agent, or Firm*—Roylance, Abrams, Berdo & Goodman LLP

(57) ABSTRACT

An inkjet printing head is disclosed. The inkjet printing head comprises a nozzle unit having a length in the main scanning direction corresponds to a paper width, the nozzle unit comprising a plurality of nozzle sections split in a main scanning direction, one or more of the plurality of nozzle sections are arranged forward in a secondary direction, and a first depression depressed behind the one or more forward-arranged nozzle sections.

20 Claims, 7 Drawing Sheets

INKJET PRINTING HEAD AND INKJET PRINTER USING THE SAME

CROSS-REFERENCE TO RELATED APPLICATION

This application claims the benefit under 35 U.S.C. §119 (a) of Korean Patent Application No. 10-2004-0077599, filed on Sep. 25, 2004, in the Korean Intellectual Property Office, the entire disclosure of which is hereby incorporated in its entirety by reference.

BACKGROUND OF THE INVENTION

1. Field of the Invention

The present invention relates to an inkjet printing head and an inkjet printer using the same. More particularly, the present invention relates to an inkjet printing head and an inkjet printer using the same including a nozzle unit having a length corresponding to the print medium, which can be various types of paper, transparencies, or other suitable medium for printing hard copies of data.

2. Description of Related Art

In general, an inkjet printer refers to an image forming device in which an ink is sprayed from an inkjet printing head, which is separated from an upper surface of a sheet of paper, and reciprocating in a paper moving direction and a direction perpendicular thereto. Recently, instead of the inkjet printing head reciprocating in a direction of the paper width, an inkjet printing head (also called, a line printing head) including a nozzle unit with a main scanning direction length corresponding to the paper width is used to achieve high-speed printing. In the above inkjet printer, the inkjet printing head is fixed so that only the paper is moved. Thus, a driving device for the inkjet printer is simple and can be used to implement high-speed printing. In the above inkjet printer, the length of the nozzle unit is, for example, about 210 mm to correspond to A4 size paper, when a printing margin in the width direction is not considered. Commonly-assigned Korean Patent Application Laid-Open Nos. 2003-64835 and 2004-10731 disclose an example of the inkjet printing head described above, the entire contents of which are incorporated herein by reference.

The paper is moved while maintaining an interval with the nozzle unit of about 1 to 2 mm. To get a high quality printing image, the interval should be constant. Four nozzle columns ejecting cyan, magenta, yellow and blue colored inks in a subscanning direction, respectively, may be arranged in the line printing head, in particular, the nozzle unit for the line printing head available for color-printing. Therefore, the length of nozzle in the sub direction is several tens of millimeters, typically, about 50 mm or more. Accordingly, as the length of the nozzle unit in the subscanning direction becomes larger, it is more difficult to maintain the constant interval between the paper and the nozzle unit when the paper passes under the nozzle unit. In addition, the paper may contact the nozzle unit. Thus, the paper may be smudged, and furthermore, the nozzle unit may be contaminated due to paper debris.

SUMMARY OF THE INVENTION

The present invention provides a line printing head and an inkjet printer using the same in which a constant interval between a paper and a nozzle unit is maintained.

According to an aspect of the present invention, there is provided an inkjet printing head comprising a nozzle unit having a length in the main scanning direction that corresponds to a paper width, the nozzle unit comprising a plurality of nozzle sections split in a main scanning direction, one or more of the plurality of nozzle sections being arranged forward in a secondary direction, and a first depression depressed behind the one or more forward-arranged nozzle sections.

The inkjet printing head can further comprise one or more second depressions depressed in front of the remaining nozzle sections other than the one or more forward arranged nozzle sections.

Each of the plurality of nozzle sections can comprise a plurality of nozzle columns arranged in a subscanning direction. The plurality of nozzle columns can comprise a first to fourth nozzle column, arranged in the second direction to eject cyan, magenta yellow and black colored inks, respectively. Each of the plurality of nozzle sections can comprise a first to third nozzle column, ejecting cyan, magenta, and yellow colored inks, respectively, the nozzle unit can further comprise a fourth nozzle column for ejecting a black colored ink, and the one or more forward arranged nozzle sections and the remaining nozzle sections can be arranged in front of and behind the fourth nozzle column, respectively.

According to another aspect of the present invention, there is provided an inkjet printer comprising an inkjet printing head with a nozzle unit having a length in the main scanning direction that corresponds to a paper width, the nozzle unit comprising a plurality of nozzle sections split in a main scanning direction, one or more of the plurality of nozzle sections are arranged forward in a secondary direction, and a first depression being disposed behind the one or more forward-arranged nozzle sections; a first moving means for moving the paper arranged at an input side of the inkjet printing head; and a guide member arranged in the first depression to guide an upper surface of the paper so the paper does not contact the nozzle unit.

According to another aspect of the present invention, there is provided an inkjet printer comprising: an inkjet printing head comprising a nozzle unit having a plurality of nozzle sections split in a main scanning direction, wherein one or more of the plurality of nozzle sections are arranged forward in a secondary direction, and wherein a nozzle unit length in the main scanning direction corresponds to a paper width; and a first depression depressed behind the one or more forward-arranged nozzle sections; a first moving means for moving the paper arranged at an input side of the inkjet printing head; and a second moving means arranged in the first depression to move the paper.

The second moving means can comprise a feed roller; and a plurality of idle rollers contacting with and rotating with reference to the feed roller, wherein the plurality of idle rollers are arranged in the first depression.

The inkjet printing head can further comprise one or more second depressions depressed in front of the remaining nozzle sections other than the one or more forward arranged nozzle sections. The inkjet printer can further comprise a first discharging means arranged at an output side of the inkjet printing head to discharge the paper, and a second discharging means arranged at the second depression to discharge the paper. The second discharging means can comprise a discharging roller; and a plurality of star wheels for contacting with and rotating with reference to the discharging roller and point-contacting with the upper surface of the paper, wherein the plurality of star wheels are arranged in the second depression.

BRIEF DESCRIPTION OF THE DRAWINGS

The above and other features and advantages of the present invention will become more apparent by describing in detail exemplary embodiments thereof with reference to the attached drawings in which.

Throughout the drawings, it should be understood that like reference numbers refer to similar features, structures and elements.

DETAILED DESCRIPTION OF EXEMPLARY EMBODIMENTS

Now, exemplary embodiments of the present invention will be described with reference to the attached drawings.

Figure 1:
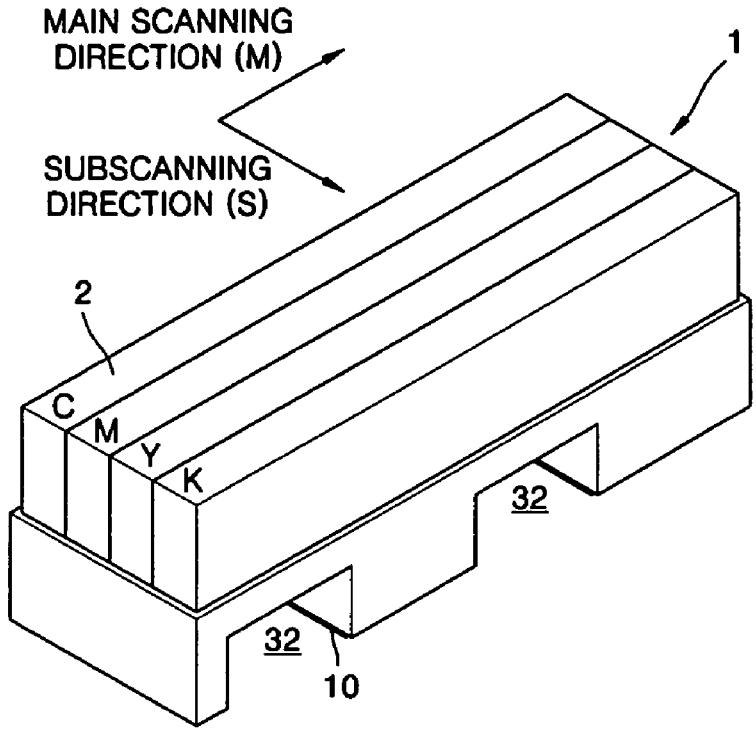
FIG. 1 is a perspective view showing an inkjet printing head according to an embodiment of the present invention.
Figure 2:
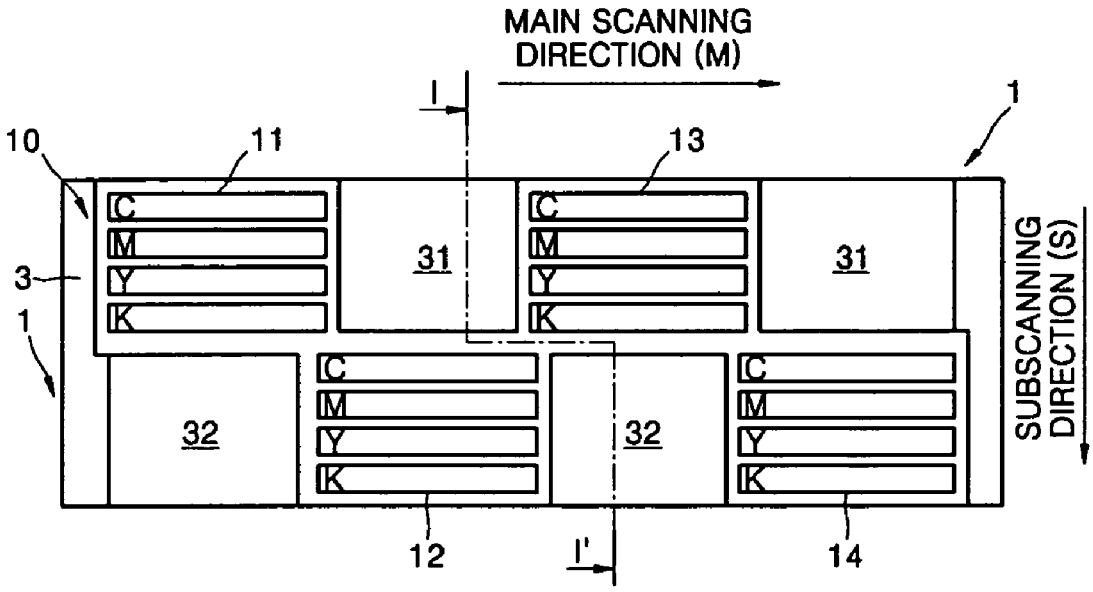
FIG. 2 is a bottom view of the inkjet printing head shown in FIG. 1, according to an embodiment of the present invention.
Figure 3:
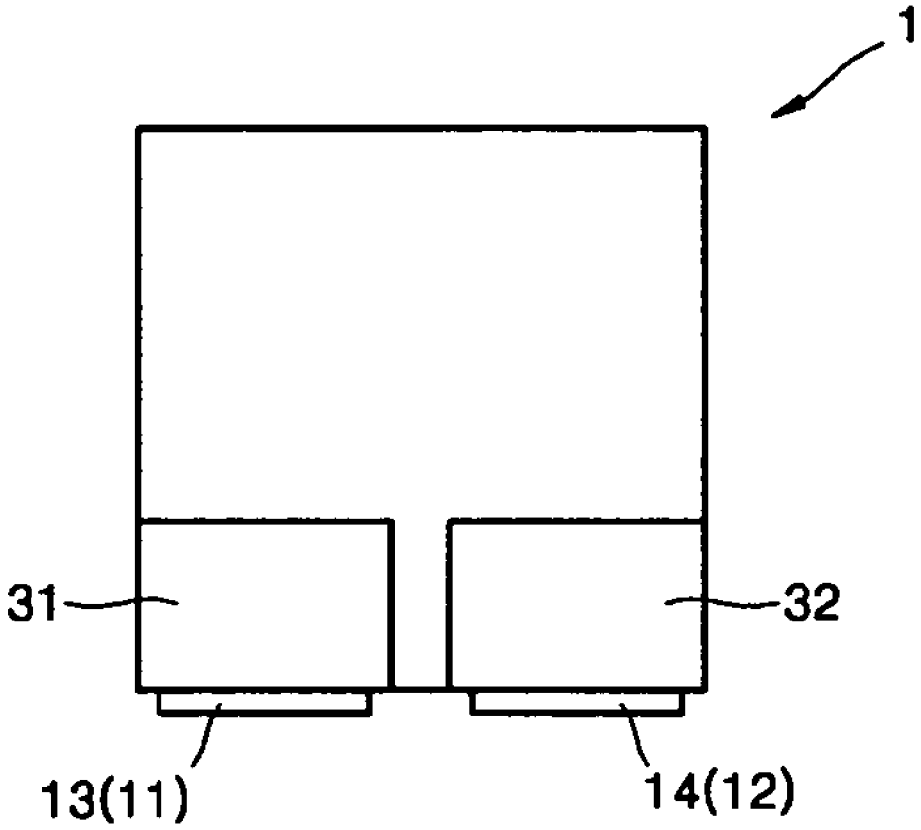
FIG. 3 is a cross sectional view taken along a line I-I' of FIG. 2.

FIG. 1 is a perspective view showing an inkjet printhead according to an embodiment of the present invention; FIG. 2 is a bottom view of the inkjet printing head shown in FIG. 1, according to an embodiment of the present invention; and FIG. 3 is a cross sectional view taken along a line I-I' of FIG. 2.

Figure 4:
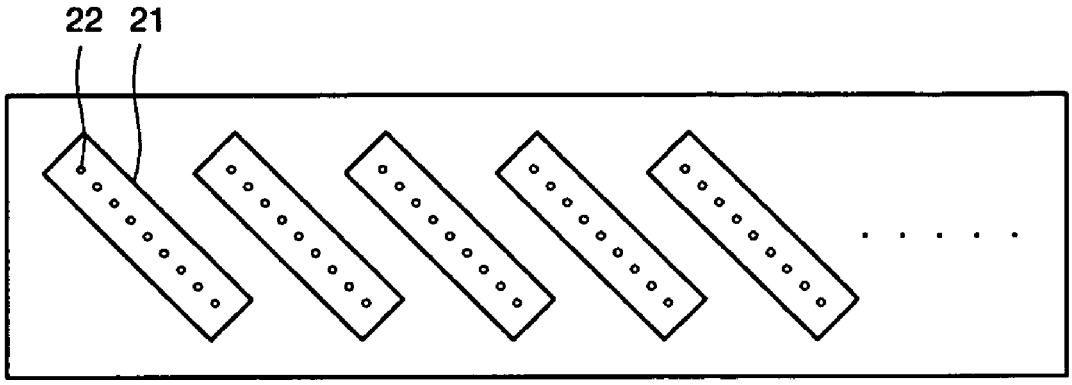
FIGS. 4 and 5 are diagrams showing examples of nozzle columns.
Figure 5:
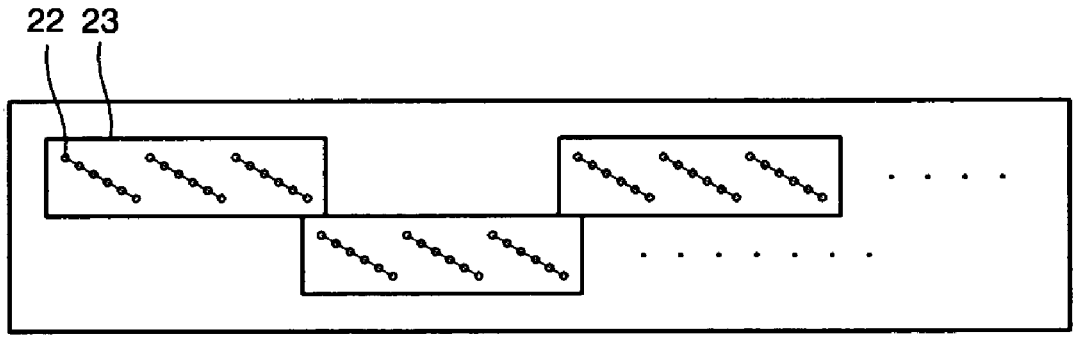

Referring to FIGS. 1 and 2, a nozzle unit 10 for ejecting inks is arranged at the bottom of an inkjet printing head 1. The ink is stored in an ink cartridge 2. Four ink cartridges 2C, 2M, 2Y, and 2K, in which cyan, magenta, yellow, and black colored inks are stored and supplied to the first to fourth nozzle columns C, M, Y, and K, are required for printing colored images. The nozzle unit 10 has a length corresponding to a paper width in a main scanning direction M. The nozzle unit 10 preferably includes 4 nozzle sections 11, 12, 13, and 14 split in the main scanning direction. Although an embodiment of the present invention has been described with reference to an example having four nozzle sections 11, 12, 13, and 14, the scope of the present invention is not limited by the number of nozzle sections. The nozzle sections 11, 12, 13, and 14 can comprise first to fourth nozzle columns C, M, Y, and K, arranged in the subscanning direction S. The first to fourth nozzle columns C, M, Y, and K can eject the same colored ink. In addition, the first to fourth nozzle columns C, M, Y and K may eject, for example, cyan, magenta, yellow, and black colored inks, respectively, to perform color printing. The first to fourth nozzle columns C, M, Y, and K can comprise a plurality of nozzle plates 21 or 23, as shown in FIGS. 4 and 5, respectively. A plurality of nozzles 22 for ejecting inks are arranged on the nozzle plates 21 and 23, respectively. The interval of the nozzles 22 represents a resolution of the main scanning direction M of the inkjet printing head 1 in the main scanning direction M. Although not shown, the inkjet printing head 1 further preferably comprises a chamber having an ejecting means (such as a piezoelectric device, or a heater) connected with the respective nozzles and applying a pressure to eject inks; and a flow path through which the inks are supplied from the ink cartridges to the chamber. The chamber, the ejecting means, the flow path and the like are well known to those skilled in the art, so the detailed description thereof will be omitted.

An embodiment of the present invention is characterized in an arrangement of the nozzle sections 11, 12, 13, and 14. As shown in FIG. 2, the nozzle sections 12 and 14 are arranged forward in the subscanning direction S. Behind the nozzle sections 12 and 14, a first depression 31 depressed from a bottom surface 3 is arranged, as shown in FIG. 3. In addition, in front of the nozzle sections 11 and 13, a second depression 32 depressed from the bottom surface 3 may be arranged, as shown in FIG. 3. Accordingly, when a paper is moved under the nozzle unit 10, the nozzle sections 11 and 13 and the nozzle sections 12 and 14 sequentially eject inks onto the paper to form images.

In general, a moving means moving the paper and a discharging means discharging the paper are arranged at the input and output sides of the nozzle unit 10, respectively. In the line-printing inkjet printing head 1, the length of the nozzle unit 10 is longer in the subscanning direction. Accordingly, there is provided a long distance between the moving means and the discharging means. Therefore, it is difficult to maintain the interval between the nozzle unit 10 and the printing medium, such as paper. The first and second depressions 31 and 32 are provided to give a space in which the moving means and/or the discharging means can be arranged as close as possible to the nozzle unit 10 to stably move the paper. The merits of the inkjet printing head 1 described above will now be described in more detail with reference to FIG. 6.

Figure 6:
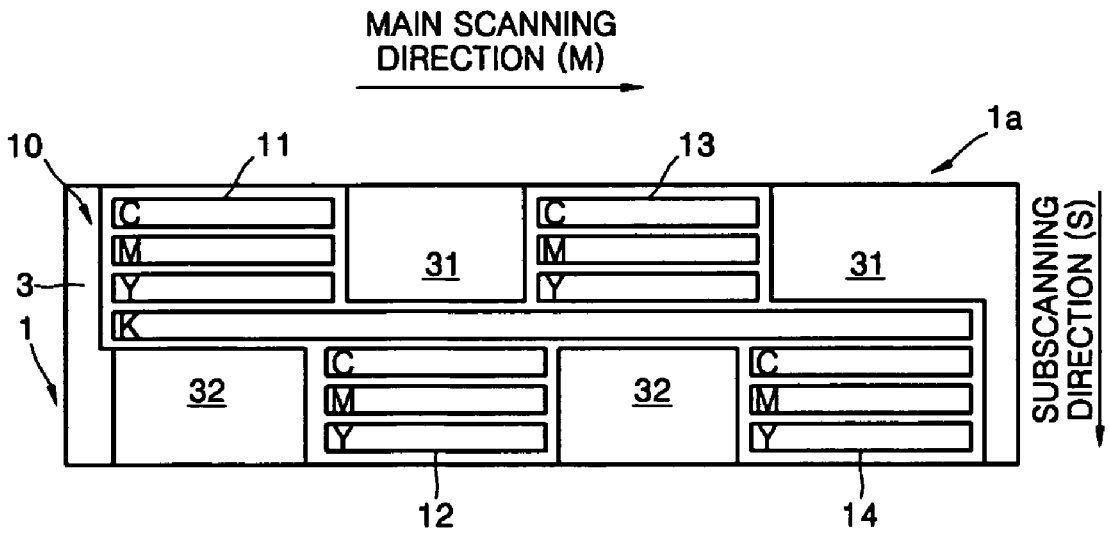
FIG. 6 is a bottom view showing an inkjet printing head according to another embodiment of the present invention.

FIG. 6 is a bottom view showing an inkjet printing head according to an embodiment of the present invention. The inkjet printing head 1 comprises a nozzle unit 10 split into four nozzle sections 11, 12, 13, and 14. Each of the nozzle sections 11, 12, 13, and 14 preferably has first to third nozzle columns C, M, and Y, respectively, arranged in the subscanning direction S. The nozzle columns C, M, and Y eject cyan, magenta, and yellow colored inks, respectively. The nozzle unit 10 preferably further comprises fourth nozzle column K ejecting a black colored ink. The nozzle sections 12 and 14 are arranged in front of the fourth nozzle column K, and the nozzle sections 11 and 13 are arranged behind the fourth column K, respectively. A first depression 31 depressed from the bottom surface 3 is arranged behind the nozzle sections 12 and 14, as shown in FIG. 3. In addition, a second depression 32, which is depressed from the bottom surface 3, may be arranged in front of the nozzle sections 11 and 13, as shown in FIG. 3. When quality of the line image is poor, the quality of the entire printing image seen by the user may be poor. In many cases, the line image is a black image, so that the fourth nozzle column K for printing the black images can be arranged in a straight line to improve the quality of the line image.

Figure 7:
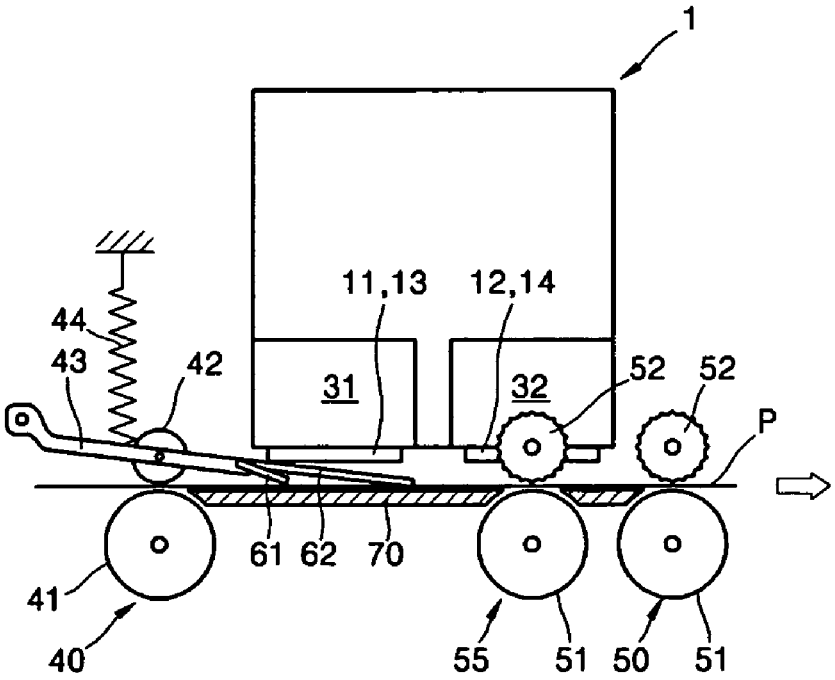
FIG. 7 is a side elevational view of an inkjet printer according to an embodiment of the present invention.
Figure 8:
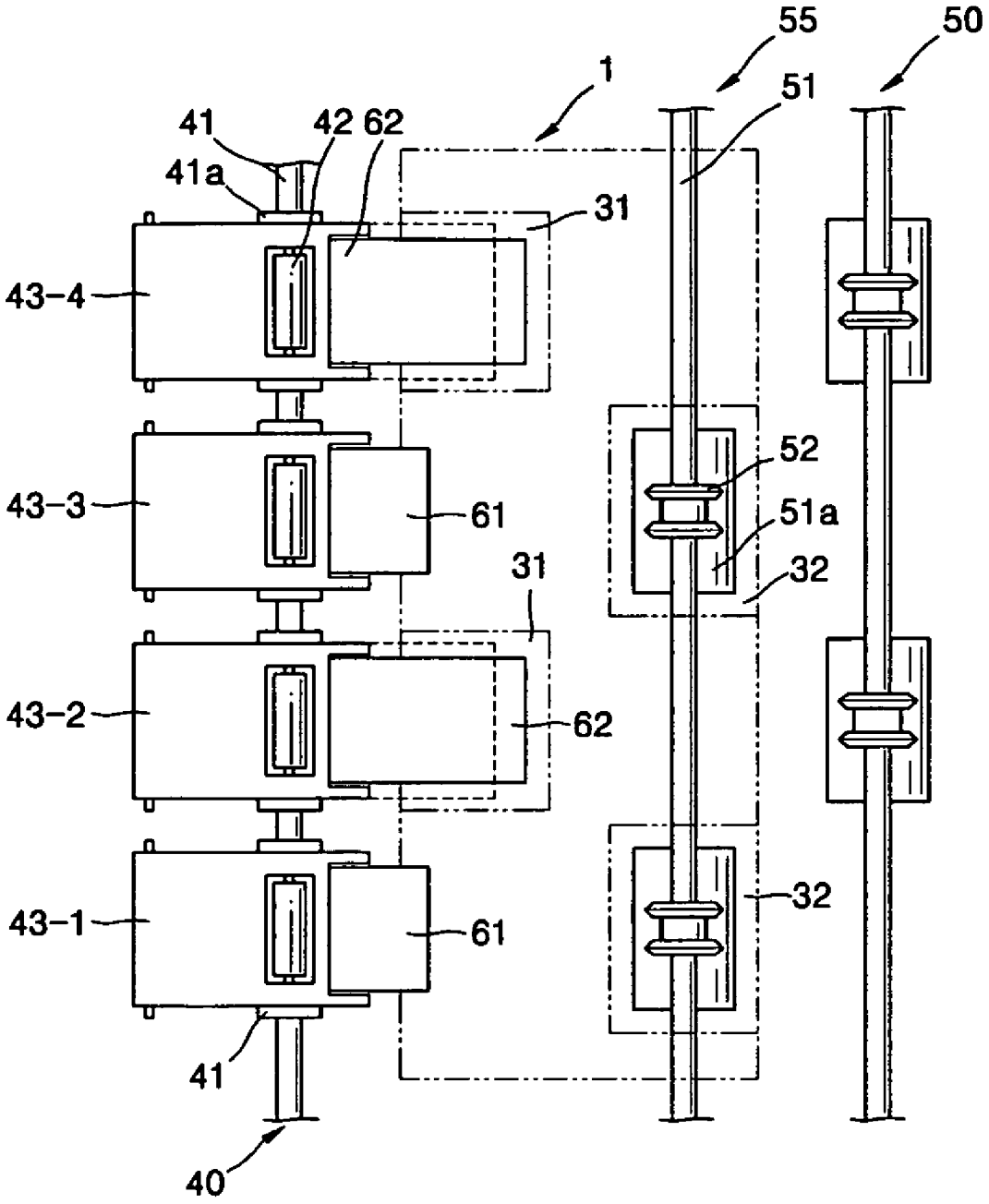
FIG. 8 is a plan view of FIG. 7.

FIG. 7 is a side elevational view of an inkjet printer according to an embodiment of the present invention, and FIG. 8 is a plan view of FIG. 7. Referring to FIGS. 7 and 8, a first moving means 40 and a first discharging means 50 are arranged at input and output sides of the inkjet printing head 1, respectively. As an example, the first moving means 40 includes a feed roller 41, and a plurality of idle rollers 42 contacting and rotating with reference to the feed roller 41. The feed roller 41 preferably comprises a plurality of rubber rollers 41*a* (shown in FIG. 8) arranged in the subscanning direction. The plurality of idle rollers 42 preferably contact the rubber rollers 41*a*. The idle roller 42 is rotatably connected to a holder 43. An elastic member 44 gives an elastic force to the holder 43 in a direction such that the idle roller 42 contacts the rubber roller 41*a*. As an example, the first discharging means 50 includes a discharging roller 51, and a plurality of star wheels 52 contacting and rotating with reference to the discharging roller 51 and point-contacting with an upper surface of a paper P. A supporting member 70 faces the nozzle unit 10 to support the bottom surface of the paper P, and maintains the interval between the paper P and the nozzle unit 10. The nozzle unit 10 comprises nozzle sections 11, 12, 13 and 14. The interval between the paper P and the nozzle unit 10 is, for example, about 0.5 to 2 mm. When the paper P is moved under the nozzle unit 10 by the first moving means 40, the ink is ejected from at least one of nozzle sections 11, 12, 13 and 14, which comprise the nozzle unit 10, to form the image on the upper surface of the paper P. Next, the first discharging means 50 discharges the paper.

The length of the nozzle unit 10 in the subscanning direction S is several tens of millimeters, typically about 50 mm or more, which is a significantly longer distance than that traveled by the inkjet printing head coming and going in the main scanning direction M. In general, a guide member 61 for guiding the upper surface of the paper P is arranged between the first moving means 40 and the nozzle unit 10 such that the paper P does not float. However, the guide member 61 cannot extend under the nozzle unit 10. Therefore, until the front end of the paper P is moved by the first moving means 40 reaches the first discharging means 50, so the paper P movement is not unstable. After the end of the paper P leaves the first moving means 40, the paper P movement is not unstable since the paper P is moved by the first discharging means 50. Therefore, the chance is very high that the interval between the paper P and the nozzle unit 10 is not maintained and the paper P contacts with the nozzle unit 10. When the ink is ejected onto the paper P, the ink saturates the paper P such that it may become warped or disintegrate. The paper moving speed of the first discharging means 50 is slightly higher than that of the first moving means 40 to flatten the paper P. Nevertheless, for the inkjet printer employing the line-printing inkjet printing head 1, the interval between the first moving means 40 and the first discharging means 50 is large. Therefore, there is a high risk in that, even when the paper is moved and engages the first moving means 40 and the first discharging means 50, the paper P may contact with the nozzle unit 10 due to the warped surface of the paper P. The paper moving speed of the first discharging means 50 is higher than that of the first moving means 40. Therefore, even when the end of the paper P leaves the first moving means 40, the images printed at the end of the paper P will be incomplete and of degraded quality. For the inkjet printer employing the line-printing inkjet printing head 1, the space interval between the first moving means 40 and the first discharging means 50 is large so that an area where the incomplete image is printed also becomes large.

To solve the foregoing problems, the line-printing inkjet printer according to an embodiment of the present invention comprising the inkjet printing head 1 (or 1*a*) as illustrated in FIGS. 1 and 6. Now, the inkjet printer having the inkjet printing head 1 will be described. The inkjet printing head 1 comprises a first depression 31. Referring to FIGS. 7 and 8, the inkjet printer according to an embodiment of the present invention comprises a guide member 62 arranged in the first depression 31 to press the upper surface of the paper P so the paper does not contact the nozzle unit 10. The guide member 61 for guiding the paper P up to the nozzle sections 11 and 13 is coupled to holders 43-1 and 43-3. In addition, the guide member 62 that guides the paper P up to the nozzle sections 11 and 13 is coupled to holders 43-2 and 43-4. The holders 43-2 and 43-4 may be extended up to the first depression 31, as is represented by a dotted line of FIG. 8. Accordingly, the paper P can be guided so it does not float at least until the front end of the paper P reaches the nozzle sections 12 and 14. Thus, the risk that the paper P will contact the nozzle unit 10 can be reduced until the front end of the paper P reaches the first discharging means 50. Although not shown, the guide member 62 can also be directly coupled to the inkjet printing head 1.

The inkjet printing head 1 further comprises the second depression 32. Referring to FIGS. 7 and 8, the inkjet printer according to an embodiment of the present invention can further comprise a second discharging means 55 arranged in the second depression 32 to discharge the paper P. As an example, the second discharging means 55 includes a discharging roller 51 and a plurality of star wheels 52, as in the first discharging means 50. The star wheels 52 are arranged in the second depression 32. In other words, the second depression 32 accommodates the star wheel 52. Accordingly, the section where the front end of the paper P becomes unstable when moved can be reduced. In the case where the guide member 62 is arranged in the first depression 31, the section where the front end of the paper P becomes unstable when moved can be further reduced. In addition, after the end of the paper P leaves the first moving means 40, the paper P is moved by the first and second discharging means 50 and 55. Therefore, the risk that the paper P will contact the nozzle unit 10 can be reduced.

Figure 9:
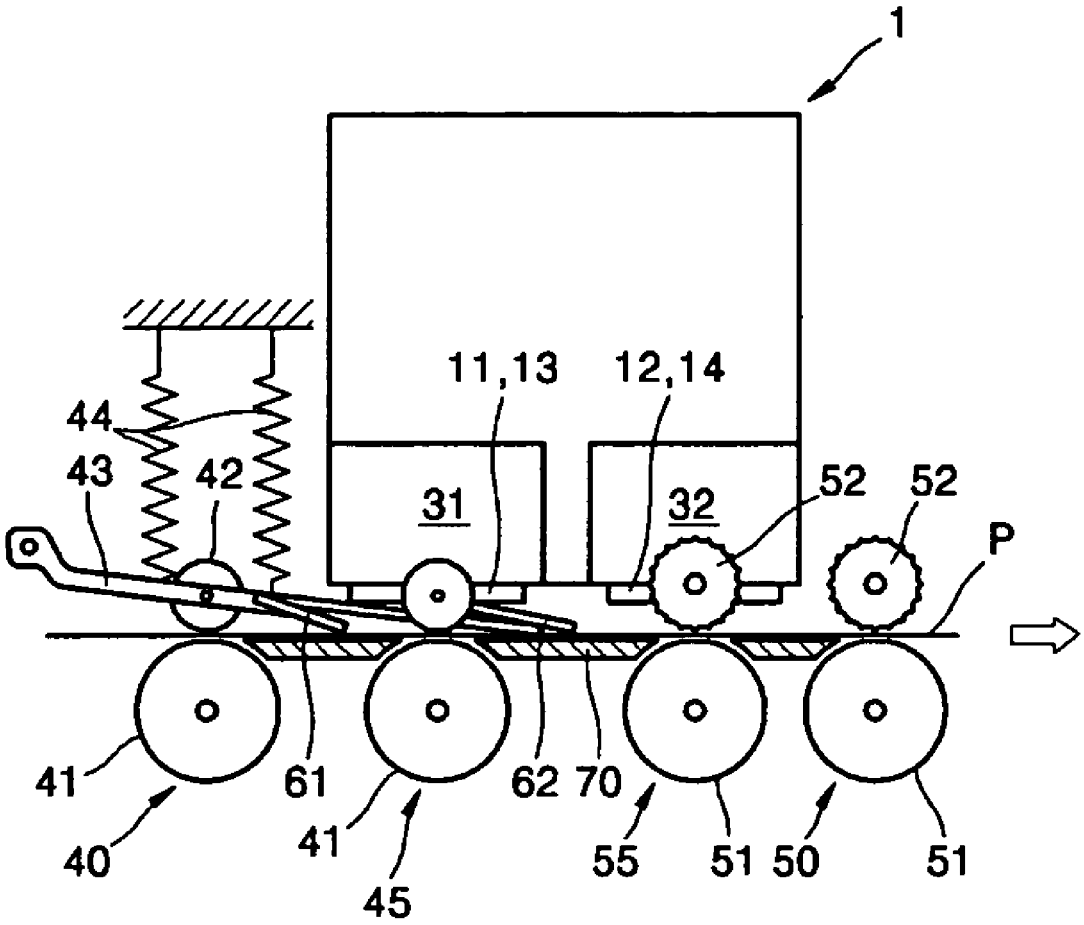
FIG. 9 is a side elevational view of an inkjet printer according to another embodiment of the present invention.
Figure 10:
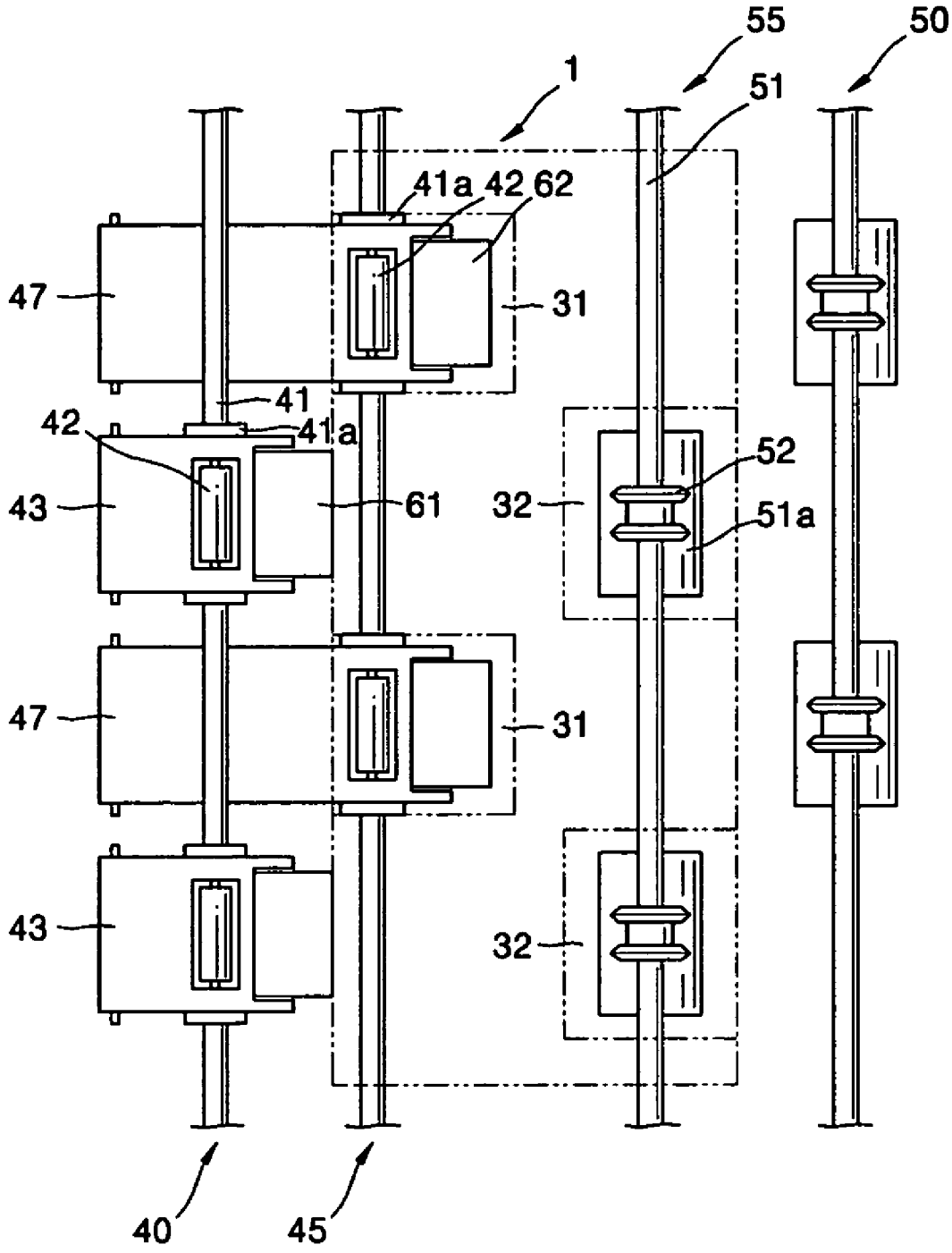
FIG. 10 is a plan view of FIG. 9.

As shown in FIGS. 9 and 10, the inkjet printer according to an embodiment of the present invention can further comprise the second moving means 45 arranged in the first depression 31. As an example, the second moving means 45 comprises the feed roller 41, and the plurality of idle rollers 42 contacting with and rotating with reference to the feed roller 41. The feed roller 41 comprises the plurality of rubber rollers 41*a* arranged in the subscanning direction S, and the plurality of idle rollers 42 contacts with the rubber rollers 41*a*. The idle rollers 42 are rotatably coupled to the holder 47. The elastic member 44 provides an elastic force to the holder 47 in the direction where the idle roller 42 contacts with the rubber rollers 41*a*. The idle rollers 42 are arranged in the first depression 31. In other words, the first depression 31 accommodates the idle rollers 42. The holder 47 is longer than the holder 43. Accordingly, the section where the paper P becomes unstable when moved is the section between the second moving means 45 and the first discharging means 50, which is shorter than the section between the first moving means 40 and the first discharging means 50. Therefore, the risk that the paper P will contact the nozzle unit 10 can be reduced, and the area of the paper P where the end of the paper P is incompletely printed can also be reduced. In addition, for the case where a second discharging means 55 is further included, the section where the paper P becomes unstable when moved becomes the section between the second moving means 45 and the second discharging means 55. Therefore, the risk that the paper P will contact the nozzle unit 10, and the area of the paper P where the end of the paper is incompletely printed can be further reduced. In addition, for the case comprising the guide member 62, the front end of the paper P can be guided up to the nozzle sections 12 and 14. Therefore, the risk that the paper P will contact the nozzle unit 10 can be even further reduced. In this case, the guide member 62 may be coupled to the holder 47. The guide member 62 may also be directly coupled to the inkjet printing head 1.

Thus, according to an inkjet printing head and an inkjet printer using the same of an embodiment of the present invention, the first depression is provided to arrange a guide member guiding a paper not to be floated and/or a moving means moving the paper. In addition, the second depression is provided to arrange a paper discharging means. Therefore, the risk that the paper will contact a nozzle unit can be reduced, and the area where the end of the paper is incompletely printed can also be reduced. In addition, an interval between the nozzle unit and the paper can remain constant so that printing quality is improved.

While the present invention has been particularly shown and described with reference to exemplary embodiments thereof, it will be understood by those skilled in the art that various changes in form and details may be made therein without departing from the spirit and scope of the invention as defined by the appended claims.

What is claimed is:

1. An inkjet printing head comprising:

a nozzle unit having a length in the main scanning direction that substantially corresponds to a paper width, the nozzle unit comprising a plurality of nozzle sections split in a main scanning direction, one or more of the plurality of nozzle sections being arranged forward in a secondary direction, and a first depression depressed behind the one or more forward-arranged nozzle sections, wherein each of plurality of nozzle sections comprise at least one nozzle column, and the at least one nozzle column comprises at least one nozzle plate on which a plurality of nozzles for ejecting inks are arranged.

2. The inkjet printing head according to claim 1, further comprising:

one or more second depressions depressed in front of the remaining nozzle sections other than the one or more forward arranged nozzle sections.

3. The inkjet printing head according to claim 1, wherein the each of plurality of nozzle sections comprise a plurality of nozzle columns arranged in the subscanning direction.

4. The inkjet printing head according to claim 3, wherein the plurality of nozzle columns comprise first to fourth nozzle columns, ejecting cyan, magenta, yellow and black colored inks, respectively.

5. The inkjet printing head according to claim 1, wherein each of the plurality of nozzle sections comprise first to third nozzle columns, arranged in the subscanning direction to eject cyan, magenta, and yellow colored inks, respectively, the nozzle unit further comprises a fourth nozzle column for ejecting black colored ink, and the one or more forward arranged nozzle sections and the remaining nozzle sections being arranged in front of and behind the fourth nozzle column, respectively.

6. An inkjet printer comprising:

an inkjet printing head comprising:

a nozzle unit having a length in the main scanning direction that substantially corresponds to a paper width, the nozzle unit comprising a plurality of nozzle sections split in a main scanning direction, wherein one or more of the plurality of nozzle sections are arranged forward in a secondary direction, and a first depression located behind the one or more forward-arranged nozzle sections;

a first moving means for moving the paper arranged at an input side of the inkjet printing head; and a guide member arranged in the first depression to guide an upper surface of the paper so the paper does not contact with the nozzle unit.

7. The inkjet printer according to claim 6, wherein the inkjet printing head further comprises one or more second depressions depressed in front of the remaining nozzle sections other than the one or more forward arranged nozzle sections.

8. The inkjet printer according to claim 7, further comprising:

a first discharging means located at an exit portion of the inkjet printing head to discharge the paper; and a second discharging means located at the second depression to discharge the paper.

9. The inkjet printer according to claim 6, wherein each of the plurality of nozzle sections comprise a plurality of nozzle columns arranged in the subscanning direction.

10. The inkjet printer according to claim 6, wherein wherein each of the plurality of nozzle sections comprise first to third nozzle columns, arranged in the subscanning direction to eject cyan, magenta, and yellow colored inks, respectively, the nozzle unit further comprises a fourth nozzle column ejecting a black colored ink, and the one or more forward arranged nozzle sections and the remaining nozzle sections are arranged in front of and behind the fourth nozzle column, respectively.

11. An inkjet printer comprising:

an inkjet printing head comprising:

a nozzle unit having a length in the main scanning direction that corresponds to a paper width, the nozzle unit comprising a plurality of nozzle sections split in a main scanning direction, wherein one or more of the plurality of nozzle sections are arranged forward in a secondary direction, and a first depression located behind the one or more forward-arranged nozzle sections;

a first moving means for moving a print medium arranged at an input side of the inkjet printing head; and a second moving means arranged in the first depression to move the print medium.

12. The inkjet printer according to claim 11, wherein the second moving means comprises:

a feed roller; and a plurality of idle rollers contacting with and rotating with reference to the feed roller, wherein the plurality of idle rollers are arranged in the first depression.

13. The inkjet printer according to claim 11, further comprising:

a guide member arranged in the first depression to guide an upper surface of the print medium so the paper does not contact the nozzle unit.

14. The inkjet printer according to claim 11, wherein the inkjet printing head further comprises one or more second depressions located in front of the remaining nozzle sections other than the one or more forward arranged nozzle sections.

15. The inkjet printer according to claim 14, further comprising:

a first discharging means arranged at an output side of the inkjet printing head to discharge the print medium.

16. The inkjet printer according to claim 15, further comprising:

a second discharging means arranged at the second depression to discharge the print medium.

17. The inkjet printer according to claim 16, wherein the second discharging means comprises:

a discharging roller; and a plurality of star wheels contacting with and rotating with reference to the discharging roller and point-contacting with the upper surface of the print medium, wherein the plurality of star wheels are arranged in the second depression.

18. The inkjet printer according to claim 11, wherein each of the plurality of nozzle sections comprise a plurality of nozzle columns arranged in the subscanning direction.

19. The inkjet printer according to claim 18, wherein the plurality of nozzle columns comprise first to fourth nozzle columns, ejecting cyan, magenta, yellow, and black colored inks, respectively.

20. The inkjet printer according to claim 11, wherein each of the plurality of nozzle sections comprise first to third nozzle columns, arranged in the subscanning direction to eject cyan, magenta, and yellow colored inks, respectively, the nozzle unit further comprises a fourth nozzle column ejecting a black colored ink, and the one or more forward arranged nozzle sections and the remaining nozzle sections are arranged in front of and behind the fourth nozzle column, respectively.

* * * * *